US008588667B2

(12) United States Patent
Whitney et al.

(10) Patent No.: US 8,588,667 B2
(45) Date of Patent: Nov. 19, 2013

(54) TRANSFER NIP FOR AN ELECTROPHOTOGRAPHIC DEVICE, AND METHODS OF MAKING AND USING SAME

(75) Inventors: Julie Ann Gordon Whitney, Georgetown, KY (US); Kerry Leland Embry, Midway, KY (US); Bartley Charles Gould, II, Lexington, KY (US); Frank Marion Hughes, Paris, KY (US); Brandon Alden Kemp, Lexington, KY (US); Kurt Daniel Lambert, Lexington, KY (US); Niko Jay Murrell, Lexington, KY (US)

(73) Assignee: Lexmark International, Inc, Lexington, KY (US)

( * ) Notice: Subject to any disclaimer, the term of this patent is extended or adjusted under 35 U.S.C. 154(b) by 97 days.

(21) Appl. No.: 12/825,572

(22) Filed: Jun. 29, 2010

(65) Prior Publication Data

US 2011/0318070 A1 Dec. 29, 2011

(51) Int. Cl.
*G03G 15/20* (2006.01)

(52) U.S. Cl.
USPC ..... 399/313; 399/297; 399/176

(58) Field of Classification Search
USPC ..... 399/297, 313, 176, 239
See application file for complete search history.

(56) References Cited

U.S. PATENT DOCUMENTS

| | | | | |
|---|---|---|---|---|
| 6,035,154 | A * | 3/2000 | Takahata et al. | 399/66 |
| 2004/0096248 | A1* | 5/2004 | Tomizawa | 399/313 |
| 2004/0126156 | A1* | 7/2004 | Stelter et al. | 399/313 |

* cited by examiner

*Primary Examiner* — Walter L Lindsay, Jr.
*Assistant Examiner* — Roy Y Yi

(57) ABSTRACT

An imaging apparatus having a toner transfer station, including a donating member for donating toner forming an image; and a transfer roll which serves to form a transfer nip in which toner is transferred from the donating member to a media sheet disposed in the transfer nip between the donating member and the transfer roll, wherein a product of a resistivity of the transfer nip and a dielectric constant thereof is greater than or equal to a product of a resistivity of the media sheet and a dielectric constant thereof.

30 Claims, 6 Drawing Sheets

TRANSFER NIP FOR AN ELECTROPHOTOGRAPHIC DEVICE, AND METHODS OF MAKING AND USING SAME

BACKGROUND

1. Field of the Invention

The present invention relates generally to an image forming apparatus and, more particularly, to a system and method for determining electrical and geometrical parameters of a transfer nip for transferring toner in an electrophotographic system.

2. Description of the Related Art

This invention concerns the transfer process for electrophotographic printers. It applies to both two step transfer and direct-to-paper imaging systems. Specifically it applies to the transfer process, whereby toner is moved from a donating medium, such as a transfer belt, to an accepting medium, such as a sheet of paper or transparency.

Transfer is a core process in an electrophotographic printing process. The process starts when a photosensitive roll, such as a photoconductor, is charged and then selectively discharged to create a charge image. The charge image is developed by a developer roll covered with charged toner of uniform thickness. This developed image then travels to what is referred to as "first transfer" in the case of a two step transfer system, or the only transfer process in the case of direct-to-paper systems.

In either system, the toner enters a transfer nip area between a photoconductor roll and a transfer roll. The media to which the developed toner image is to be transferred, either a transfer belt for a two step transfer system or a transport belt supporting paper for a direct-to-paper system, is positioned between these two rolls. Time, pressure and electric fields all influence the quality of the transfer process. A voltage is applied to the transfer roll to create a field to pull charged toner off the photoconductor onto the desired medium.

In a two step transfer system, the transfer belt, now carrying the charged toner, travels to a second transfer nip, similar in some ways to the first transfer nip. The toner is again brought into contact with the toner receiving medium in the second transfer nip formed by a number of rolls. Typically a conductive backup roll and a resistive transfer roll together form the two primary sides of the second transfer nip. As with the first transfer, time, pressure and applied fields play significant roles in ensuring high efficiency transfer.

Transfer robustness is frequently measured as the amount of voltage between the lowest voltage at which acceptable transfer occurs due to a sufficient electric field having been established to move toner, and the highest voltage at which acceptable printing occurs before Paschen breakdown, i.e., the voltage at which the dielectric properties of the materials in the transfer nip begin to break down, causes undesirable print artifacts. This robustness varies across environments as the properties of the receiving media vary over those same environments. The larger the difference between the lowest and highest voltages, the more tolerance exists for part-to-part variation while still yielding relatively good quality prints.

The low end of the transfer window is typically determined by how well the electric field, measured in volts/meter, can be established, and by how much electric field is then required to overcome the forces of adhesion between the toner and the donating medium. The high end of the transfer window is the point at which the electric field established to transfer the toner exceeds the Paschen breakdown limit, allowing a discharge event to happen. Depending on the location of the breakdown, various print defects will be present in the page which would make the print unacceptable.

An ongoing demand exists in the printer industry for a faster, more versatile printer that provides higher print quality. Process speeds for printers have steadily increased and the present goal is to have smaller, stand-alone printers which can deliver high print quality at speeds once reserved for large printing presses. In addition to faster speed requirements, the demands for smaller sizes of these systems mean that they can be more readily placed in less climate-controlled locations while maintaining their high quality output. Changes in temperature and relative humidity have been seen to have a relatively sizeable impact on the electrical properties of the media on which the systems print.

For instance, recent volume resistivity measurements of a variety of common printer media over a class B range of environmental conditions have shown a shift in volume resistivity equal to about eight orders of magnitude over the range measured.

In addition to changes in resistance due to temperature and moisture content, paper resistance is also strongly influenced by the electrical field placed across the sheet. While a conventional resistor behaves according to Ohm's Law, paper resistance changes with the applied voltage field. This non-ohmic behavior is a function of a charge separation that takes place inside the media in response to any externally applied electrical field. For instance, for bond paper at 60 degrees C. and 8% relative humidity, a drop in resistance of over 75% has been seen in response to a change in voltage across the bond paper from about 500 v to about 1500 v.

A further complication with the electrical properties of paper is that the amount of time for charge separation to occur is a function of the material resistance, which is changing both in environment and by the applied electric field. The chart of FIG. 1 shows an approximate voltage versus time response for Hammermill® Laser 24# paper at two different environments: 72 degrees F., 50% relative humidity; and 60 degrees F., 8% relative humidity.

What may be the most significant complication concerning paper's electrical properties is that the dielectric breakdown strength thereof is seen to be relatively strongly influenced by the environment. The electric field that a paper can withstand when dry is seen to be significantly higher than the electric field the same paper can support when in a humid environment. For an example, Strathmore bond writing paper, 24#, has a dielectric breakdown strength of about 1780 volts at 60 degrees F. and 8% relative humidity, but at 78 degrees F. and 80% relative humidity the breakdown strength is only about 400 volts, which is less than 25% of the corresponding dry value. Other paper has been seen to respond similarly.

As described above, paper and a toner-covered donating medium (belt or photoconductor) enter the transfer nip where an electric field and pressure cause the toner to transfer from the donating medium to the paper. The length of time in the nip affects how quickly the electric field must be established such that there is a sufficient Lorenz force to cause the toner to move. The faster the process speed of the printer, the less time the paper and other nip components have to respond and create a good situation for toner transfer.

Traditionally, the time constant of the transfer nip is controlled by the transfer roller, and the resistance of the foam for that roller is chosen to be appropriate for the speed of the printer and therefore the time in the nip. If the printer is to operate at faster speeds, the resistivity of the roll is decreased in order to provide for an appropriate time constant to meet the new process speed requirements.

Unfortunately, as the resistivity of the transfer roll drops the onset of over transfer defects occurs at lower voltages than the corresponding decrease in the voltage required to achieve good transfer. In other words, the robustness of the system, as measured by the voltage width of the transfer window, decreases. Defects associated with this decrease in robustness include a speckling defect caused by electrical breakdown of paper in the transfer nip when the paper is dry. When the paper is more humid the over transfer defect is more spread out and a fading of low charge areas like half tones or low charge solid areas result. Both of these defects result in reduced print quality for the printer user.

Based upon the foregoing, there is a need for an improved transfer nip in an electrophotographic imaging system.

SUMMARY OF THE INVENTION

Embodiments of the present invention overcome shortcomings seen in prior transfer nip designs and thereby satisfy a significant need for an electrophotographic imaging system having transfer nip characteristics that provide higher print quality at increased speeds over a relatively large range of environmental conditions.

In accordance with an exemplary embodiment of the present invention, there is shown an imaging apparatus having a donating member for donating toner forming an image, and a transfer roll which serves to form a transfer nip in which toner is transferred from the donating member to a media sheet disposed in the transfer nip between the donating member and the transfer roll. A product of the transfer nip resistivity and dielectric constant is greater than or equal to the product of the media sheet resistivity and dielectric constant. By having the resistivity-dielectric constant product of the transfer nip at least equal to the resistivity-dielectric constant product of the media sheet, breakdown of the media sheet is substantially avoided, thereby reducing the print defects associated therewith.

In one exemplary embodiment, to accommodate a process speed of at least about 250 mm/sec, the transfer roll may have a resistivity between about 9.4 log ohm-cm and about 10.2 log ohm-cm and a foam thickness between about 3 mm and about 6 mm, and the transfer nip may be between about 4 mm and about 12 mm wide.

Additional features and advantages of the invention will be set forth in the detailed description which follows and in part will be readily apparent to those skilled in the art from that description or recognized by practicing the invention as described herein, including the detailed description, which follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent will be better understood by reference to the accompanying drawings, wherein.

DETAILED DESCRIPTION

Figure 1:
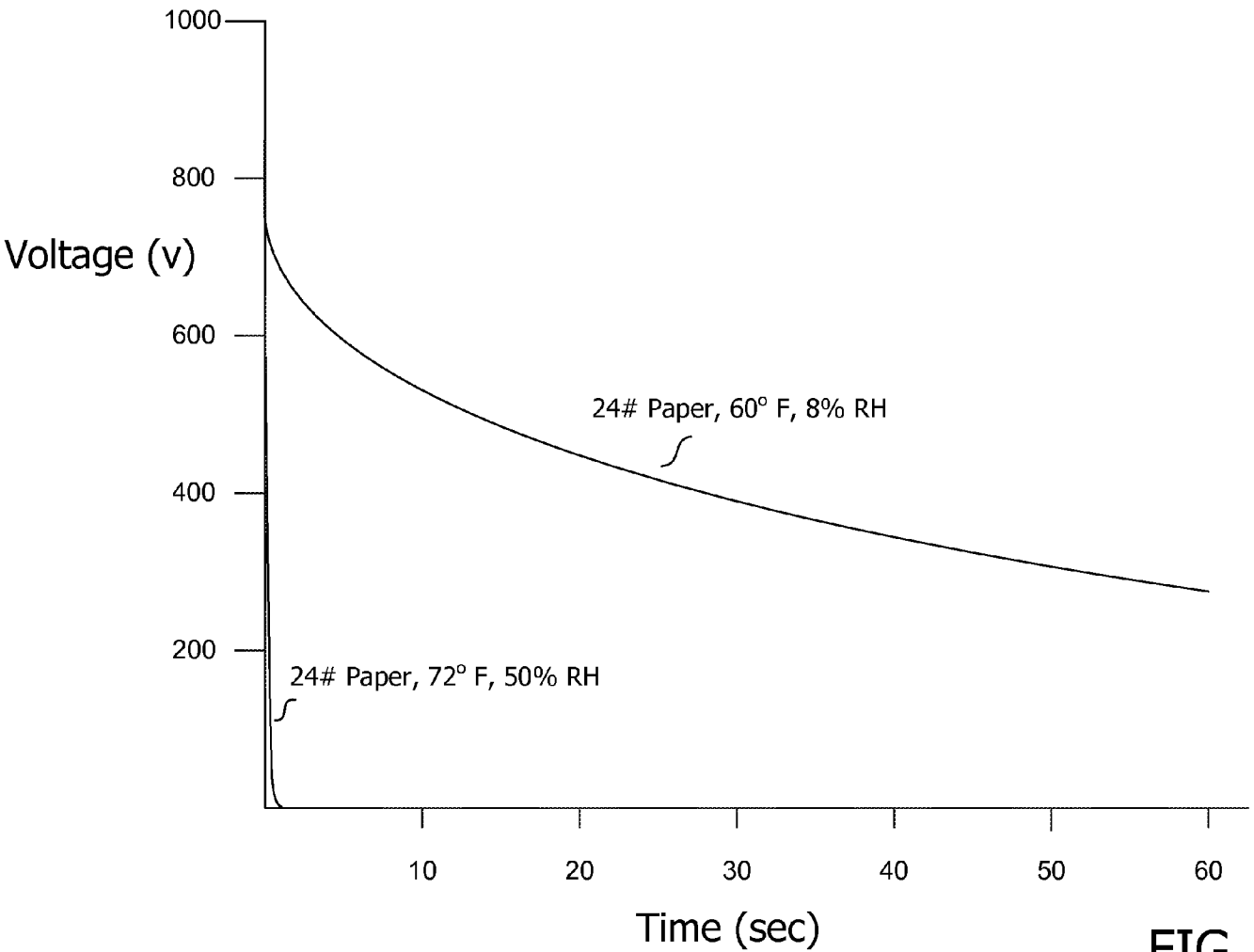
FIG. 1 is a chart illustrating the changes in voltage response time of a sheet of media due to changes in temperature and relative humidity.

It is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof are used broadly and encompass direct and indirect connections, couplings and mountings. In addition, the terms "connected" and "coupled" and variations thereof are not restricted to physical or mechanical connections or couplings.

Reference will now be made in detail to the exemplary embodiment(s) of the invention, as illustrated in the accompanying drawings. Whenever possible, the same reference numerals will be used throughout the drawings to refer to the same or like parts.

Figure 2:
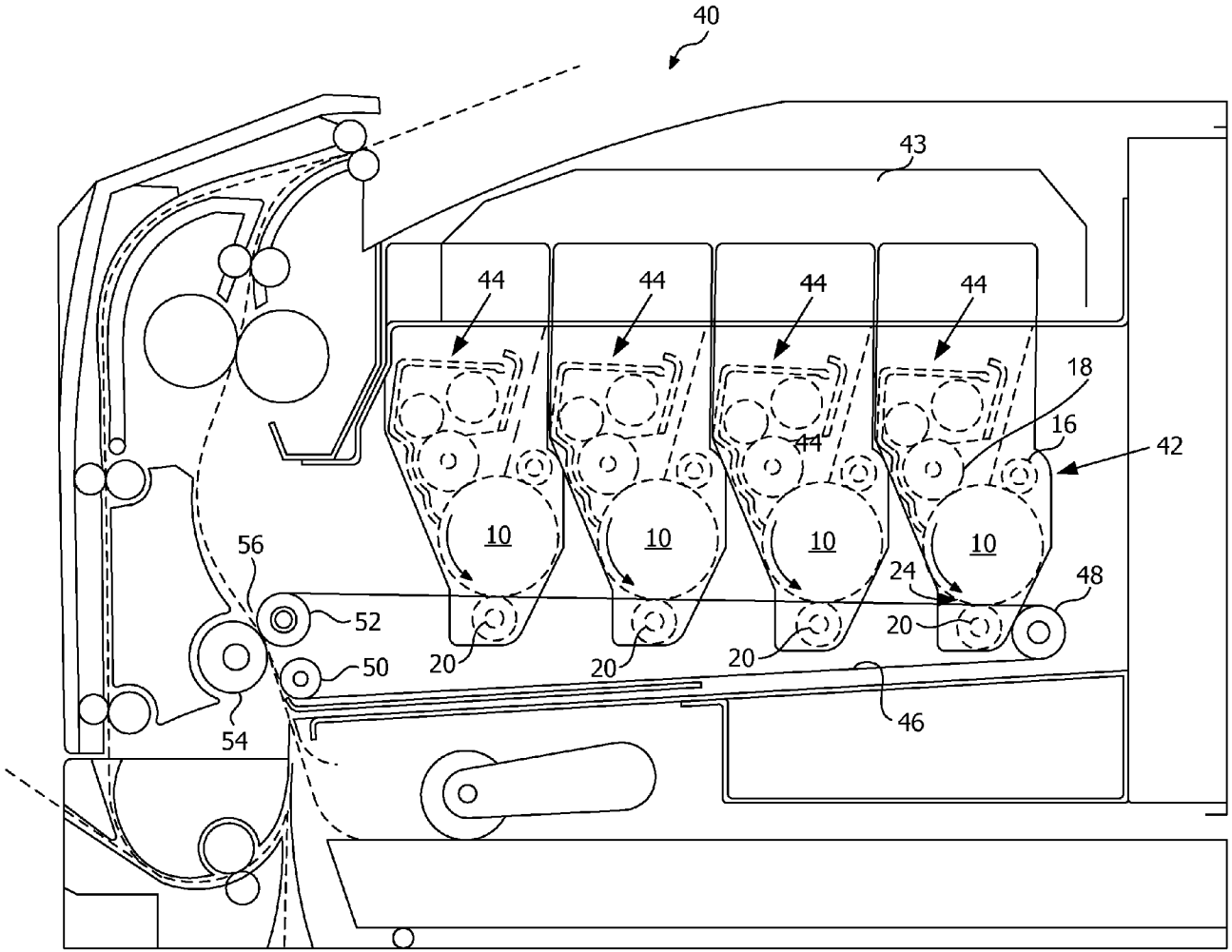
FIG. 2 is side view of a two step electrophotographic imaging system utilizing features of exemplary embodiments of the present invention.

FIG. 2 illustrates an imaging apparatus 40 that shows a two-step transfer of a toner image from photoconductive drums 10 to a sheet of media utilizing aspects of an exemplary embodiment of the present invention. Imaging apparatus 40 includes four independent imaging units 44 for printing with cyan, magenta, yellow, and black toner to produce a color image. Each imaging unit 44 includes a charge member 16, developer roll 18, and photoconductive drum 10. The charge member 16 charges the surface of the photoconductive drum 10 to a specified voltage, such as −1000 volts. A laser beam from a laser scan unit 43 contacts the surface of each photoconductive drum 10 and discharges those areas it contacts to form a latent image. The developer roll 18 serves to develop toner into the latent image on the photoconductive drum 10. The toner particles are attracted to areas of the surface of photoconductive drum 10 discharged by the laser beam from laser scan unit 43. Each of the four photoconductive drums 10 is positioned opposite a corresponding transfer roller 20 such that four first transfer nips 24 are formed therewith.

An intermediate transfer member 46 is disposed adjacent to each of the imaging units 44. In this embodiment, the intermediate transfer member 46 is formed as an endless belt disposed about support roller 48, tension roller 50 and back-up roller 52. During image forming operations, the intermediate transfer member 46 moves relative to the imaging units 44. Each photoconductive drum 10 applies a toner image in its respective color to the intermediate transfer member 46 as the intermediate transfer member 46 is passed through the corresponding transfer first nip 24. This transfer of the toner images from the photoconductive drums 10 to the intermediate transfer member 46 is known as "first transfer" and takes place at a first transfer voltage.

The toner images collected by the intermediate transfer member 46 are then transferred to a media sheet at a second transfer station. The second transfer station includes back-up roller 52 and a second transfer roller 54 to form a second transfer nip 56. A second backup roller 55, shown in FIG. 3, may be used in relation to second transfer roller 54 to, among other things, increase the width of the second transfer nip 56. The transfer of toner images from the intermediate transfer member 46 to the media sheet is known as the "second transfer" and takes place at a second transfer voltage that is applied between the second transfer roller 54 and the transfer backup roller 52. It is understood that a backup roller may also be used in conjunction with transfer roll 21 to allow for an increase in the width of transfer nip 25.

After the toner image is transferred to the sheet of media at second transfer nip 56, a fusing unit 60 applies heat and pressure to fuse the transferred toner to the sheet. The sheet exits imaging apparatus 40 via exit rollers 62 or reenters the second transfer nip 56 via duplex path 64 for transferring another toner image to the reverse side of the sheet.

Figure 5:
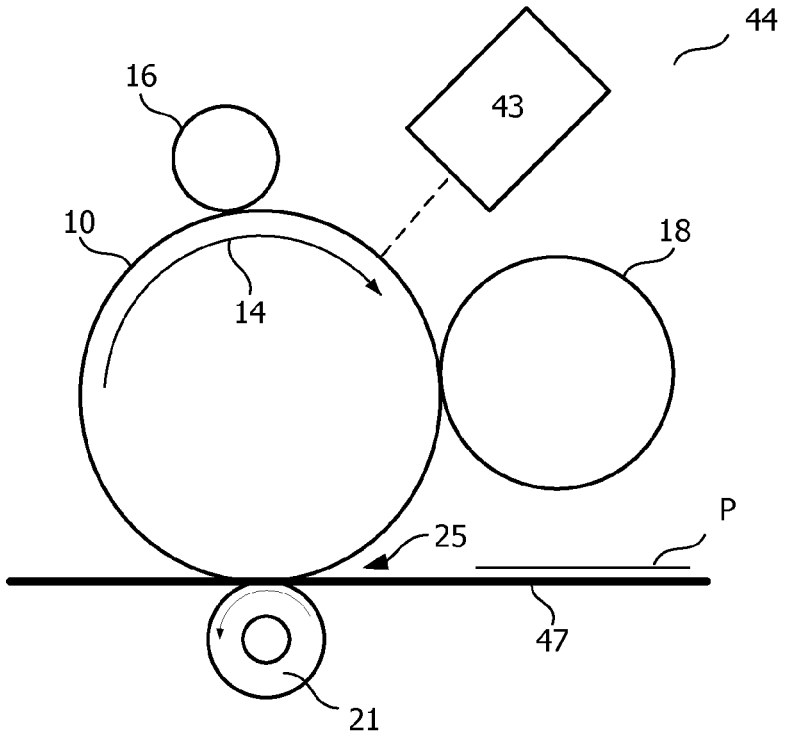
FIG. 5 is a diagram illustrating a transfer nip of FIG. 4 according to an exemplary embodiment of the present invention.
Figure 4:
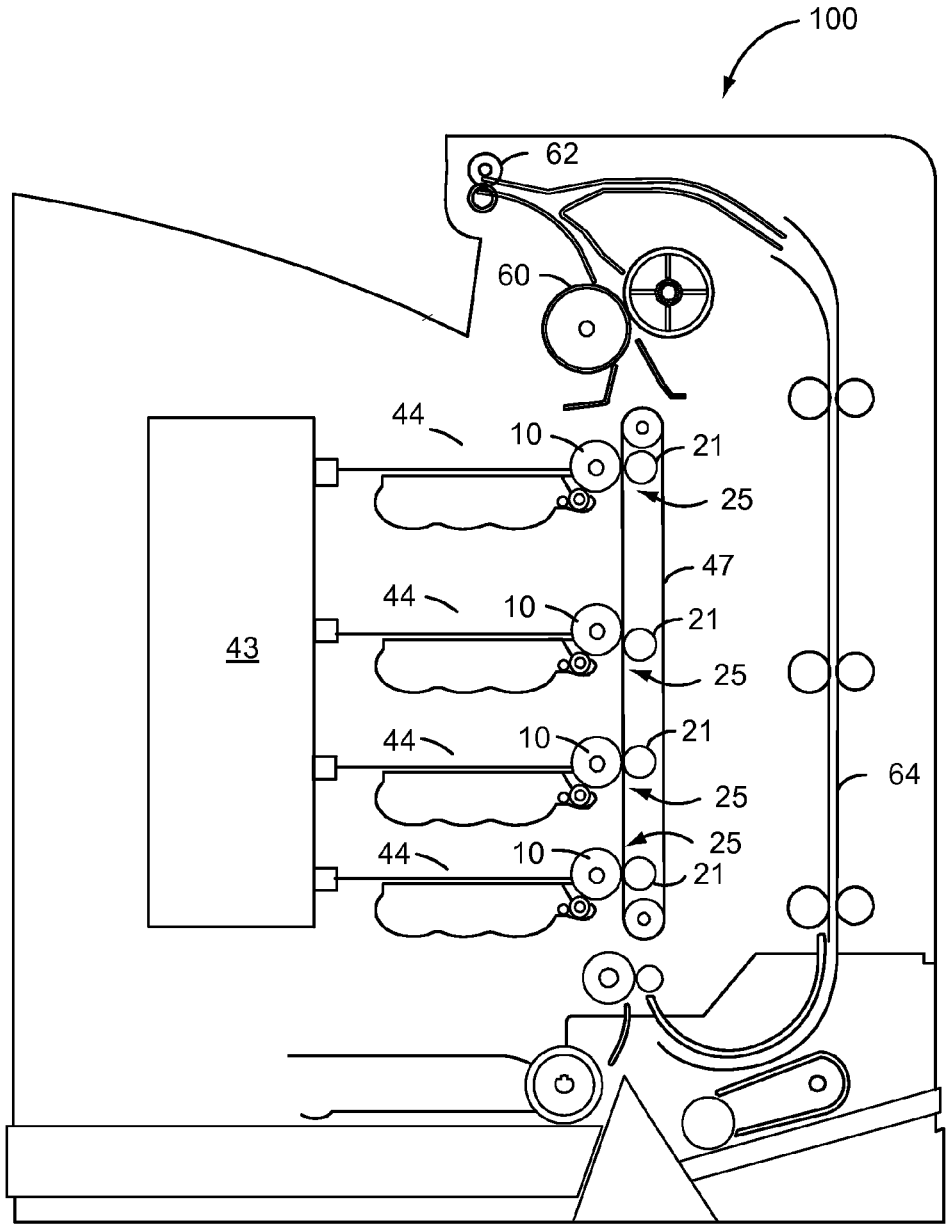
FIG. 4 is a side view of a direct-to-paper imaging system according to an exemplary embodiment of the present invention.

FIG. 4 illustrates a direct-to-paper imaging apparatus 100 in which a toner image is transferred directly from imaging units 44 to a sheet of media. Similar to the imaging units 44 depicted in FIG. 2, each imaging unit 44 of FIG. 4 (and shown in greater detail in FIG. 5) includes charge member 16, developer roll 18, and photoconductive drum 10. The charge member 16 charges the surface of the photoconductive drum 10 to a specified voltage. A laser beam from laser scan unit 43 contacts the surface of a photoconductive drum 10 and discharges those areas it contacts to form a latent image. The developer roll 18 serves to develop toner into the latent image on the photoconductive drum 10. The toner particles are attracted to areas of the surface of photoconductive drum 10 discharged by the laser. Each of the four photoconductive drums 10 is positioned opposite a corresponding transfer roller 21 such that four transfer nips 25 are formed therewith.

A transport belt 47 carries the media sheet P from an input tray to each imaging unit 44 so that the media sheet P enters the transfer nip 25 formed by photoconductive drum 10 and transfer roll 21 of the imaging unit 44. Unlike imaging apparatus 40 of FIG. 2, in imaging apparatus 100 each photoconductive drum 10 transfers its toner image directly to the media sheet P. Following toner transfer, the media sheet P is moved to fusing unit 60 whereupon the toner is fused to the media sheet P. Following the toner being fused to the media sheet P by fusing unit 60, the media sheet P exits imaging apparatus 100 via exit rollers 62 or is carried back to the first imaging unit 44 for transferring toner to the second side of media sheet P as part of a duplex print operation.

Exemplary embodiments of the present invention are directed to specifying transfer nip parameters of second transfer nip 56 of imaging apparatus 40 and transfer nips 25 of imaging apparatus 100 so that print quality and operational robustness are enhanced for a given set of requirements for speed, environmental conditions and media type. The exemplary embodiments utilize a set of relationships to specify, among other transfer nip parameters, transfer roll resistance and thickness as well as transfer nip width.

According to the exemplary embodiments of the present invention, transfer nip geometry and resistivity parameters are specified to substantially match or exceed the requirements of the worst case media sheets that imaging apparatus 40 and 100 are designed to use. In particular, the time constant of each transfer nip 25 and 56 is set to substantially match or exceed the time constant of such worst case media. With the time constant of the transfer nip 25 and 56 being at least equal to the time constant of the worst case media, charge separation in the media sheet occurs at least as fast as charge separation in transfer rolls 21 and 54 so that a substantial portion of the transfer voltage greater than the media sheet's breakdown voltage does not initially appear across the media sheet. Instead, a voltage drop across transfer roll 21 or 54 is established which prevents a large voltage drop across the media sheet, allowing charge separation to occur in the media sheet reducing media resistance. As a result, the voltage initially established across the media sheet does not exceed the sheet's breakdown voltage.

For example, if imaging system 40 needs to be able to handle a low density bond paper that has a long time constant at low temperature and humidity conditions, the electrical characteristics of the transfer nips 25 and 56 are determined to prevent the electric field across the media from exceeding the breakdown strength of the media at that temperature/humidity condition.

Once the time constant of the transfer nip is determined, and noting that the transfer nip time constant for the most part sets the time constant of transfer roll 21 and 54, the thickness T of the foam on transfer roller 21 and 54 is then determined based upon the minimum speed at which imaging apparatus 40 and 100 needs to operate as well as the toner charge and the thickness and roughness of the media to which toner is to be transferred. If the imaging apparatus 40 and 100 is to run at only one process speed, for example, the foam thickness of transfer roll 21 and 54 is determined by a voltage divider calculation so that the steady state voltage drop across the media sheet does not exceed the breakdown strength of the media or the pre-nip breakdown voltage of air. In particular, if the breakdown strength of a media sheet at 78 degrees F. and 80% relative humidity is generally around 350 volts. The resistivity of the transfer roll 21 and 54 divided by the corresponding transfer nip area and multiplied by the thickness of transfer roll 21 and 54 may approximate transfer roll nip resistance. Generally a transfer roll foam thickness of at least 0.5 mm is needed to prevent too much voltage drop across the media in a single speed system.

Pre-nip breakdown voltage happens when the electric field in the transfer nip 25 and 56 exceeds the Paschen breakdown limit in the area immediately upstream of the transfer nip. The Paschen voltage limit is frequently approximated by the linear function $$P=312\ v+(\text{gap size}\times\text{Electric field})$$

for gaps ranging from about one millimeter down to about 7 microns. When two opposing surfaces, for example the photoconductive drum 10 and the surface of transfer roll 21 and 54 exceed this limit a discharge event will happen in the air between them. When breakdown occurs, the toner charge is neutralized by attachment of positive ions to the toner particles such that the toner particles do not respond to Lorenz forces once inside the transfer nip. Since surface voltages are a function of time, distance and the applied electric field, the surface voltages cannot be simply calculated, but may be determined from a one-dimensional field model as is described in existing literature. Thinner foam at any resistivity amount has a lower resistance and the surface voltage will respond more rapidly to an applied voltage and therefore increase the risk of pre-nip breakdown.

These two parameters, resistivity and thickness, serve to define the resistance of the transfer roll 21 and 54, and from the parameters one can determine the width of transfer nip 25 and 56 that is needed to allow for a minimum acceptable electric field across the toner at the exit of the transfer nip. Through empirical analysis, a minimum transfer nip width is determined relative to a number of process speeds. For example, the nip width may be between about 4 mm and about 12 mm for a process speed of at least about 250 mm/sec; between about 4 mm and about 10 mm for a process speed between about 250 mm/s and about 350 mm/s; and between about 6 mm and about 12 mm for a process speed between about 350 mm/s and about 450 mm/s.

Further, it is known that a one dimensional mathematical model is capable of predicting the electric field acting on toner in a transfer nip as a function of resistance and process speed. The model was used to generate a set of curves, shown in FIG. 6, that may be utilized to determine the transfer nip width needed for an adequate electric field. The transfer nip width is plotted based on various transfer roll foam thicknesses (3 mm to 7 mm) and the anticipated difficulty in transferring the toner. With respect to the anticipated difficulty in transferring the toner, curves corresponding to "low difficulty" may be used in situations in which toner enters the transfer nip at less than about −25 uC/g, whereas curves corresponding to "moderate difficulty" may be used in situations in which toner enters the transfer nip at greater than about −25 uC/g or in which toner is to be transferred to paper having a roughness greater than about 20 um surface roughness. It is understood that other curves may be similarly generated based upon the particular toner charge anticipated and media types planned for use.

Figure 3:
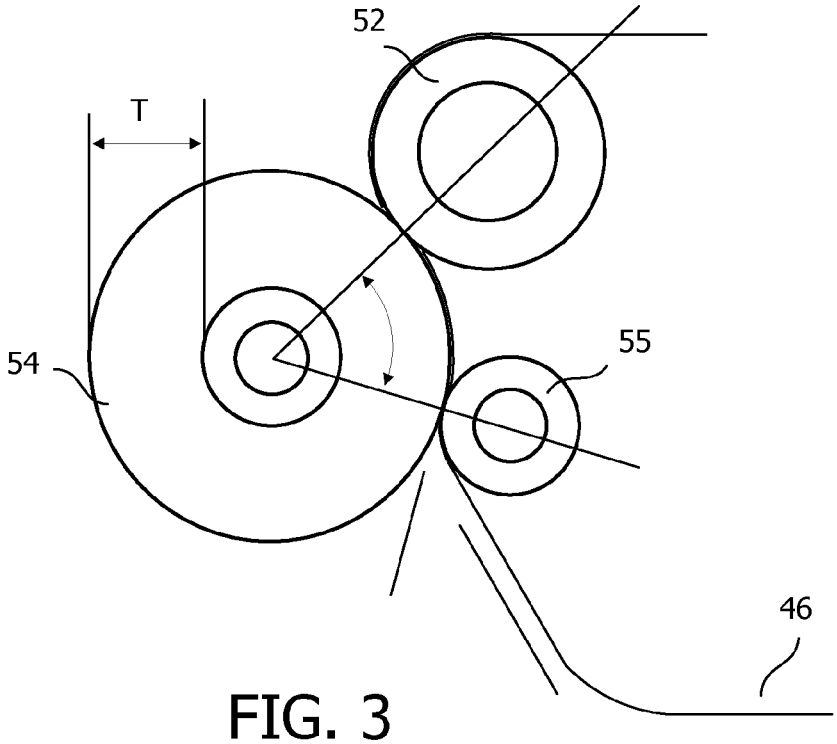
FIG. 3 is a diagram illustrating a transfer nip of FIG. 2 according to exemplary embodiments of the present invention.

Given these parameters, three rolls associated with the second transfer in imaging apparatus 40, transfer roll 54 and backup rolls 52 and 55, are brought into contact with the media sheet and intermediate transfer belt 46 having the toner image thereon. The position of the rolls is such that the more downstream nip pair (i.e., transfer roll 54 and backup roll 52) may have an equal or higher nip pressure than the initial pair (transfer roll 54 and backup roll 55) and that contact between all elements of transfer nip 56, including intermediate transfer belt 46, are maintained from such initial pair to such downstream pair. In addition, backup roll 55 need not necessarily contact transfer roll 54 if the resistance of intermediate transfer belt 46 is sufficiently low so as to cooperate in creating the transfer nip width. The effective transfer nip width is that distance from first contact to last contact or, for a very low resistance belt 46 having less than about $3\times10^9$ ohm-cm surface resistance, from first contact with backup roll 55 to last contact with the backup roll 52. In an exemplary embodiment, the moment arm applying force to transfer roll 54 is at a substantially right angle to the plane of substantially optimum or near optimum contact, as can be seen in FIG. 3. This allows for spring tolerance variation to have substantially reduced geometric impact.

The transfer nip width can be changed by modifying the angular distance between backup roll 55 and backup roll 52 along transfer roll 54. Since the first of the transfer nips impacts paper geometry input and the second impacts paper direction exit, the transfer nips formed by transfer roll 54 and backup rolls 52 and 55 can be altered by moving either or both backup rolls relative to transfer roll 54 to achieve enhanced system output.

It is additionally possible to extend the flexibility of the transfer nip by coating backup roll 55 with a thin coating of moderate dielectric breakdown strength, such as about a 50 um thick acrylic coating, that will prevent the roll from arcing to intermediate transfer belt 46 when powered. In particular, coating backup roll 55 prevents carbon tracking failures and improves design issues associated with powered elements in close proximity.

Additionally, the flexibility of the transfer nip 56 may be improved based upon the approach described in U.S. patent application Ser. No. 12/329,752, owned by the assignee of the present application, filed on Dec. 8, 2008, and entitled, "System for Tailoring a Transfer Nip Electric Field for Enhanced Toner Transfer in Diverse Environments," the content of which is hereby incorporated by reference herein in its entirety. With the addition of a second backup roll (as described herein) or an early-nip roll (as described in the above-mentioned application), the concept of field conditioning may be extended to include regions internal to the transfer nip 56. The electric field may be tailored to perform in a more optimal manner over a broader range of environmental conditions. Particularly, the wider nip method as described herein offers an improvement in field strength in dry environments whereby a high voltage having opposite polarity to that of the transfer roll 54 may be applied to the second backup roll or early-nip roll to tailor the electric field in the nip. For example, in a relatively dry environment in which the temperature may be about 60 degrees F. and the relative humidity at about 20% or less (i.e., less than about 3 grams of water per cubic meter of air at standard atmospheric pressure), the bias voltage difference between the voltage applied to transfer roll 54 and the voltage applied to backup roll 55 may be about 1800 volts to extend the field and desirably shorten the time for charge separation to occur in the media sheet. In a relatively humid environment in which the temperature may be about 90 degrees F. and the relative humidity is about 45% (i.e., at least about 12 grams of water per cubic meter of air at standard atmospheric pressure), with the bias voltage difference between the voltage applied to transfer roll 54 and the voltage applied to backup roll 55 may be about 500 volts.

Additionally, since an electric field is produced from the voltage drop over a distance, all voltages are by themselves only significant in reference to each other. It may be, for example, more desirable to set the core voltage of transfer roll 54 at the ground potential and power backup roll 55 and backup roll 52 negatively. Alternatively, both sides of transfer nip 56 may take about half of the bias with transfer roll 54 at about 1000 volts and backup roll 55 and backup roll 52 at −1000 volts, or unevenly biased as mentioned above.

With transfer nip width determined, the angle $\alpha$, defined between backup roll 55, transfer roll 54 and backup roll 52 as shown in FIG. 3, may be adjusted to yield the determined transfer nip width. The angle $\alpha$ may be between about 33 degrees and about 57 degrees, such as about 47 degrees. Once the angle $\alpha$ is set, the vector of the desired nip force between backup roll 52 and transfer roll 54 may be maintained substantially perpendicular to the exit vector of the media sheet, rather than applied evenly between backup rolls 52 and 55.

Figure 6:
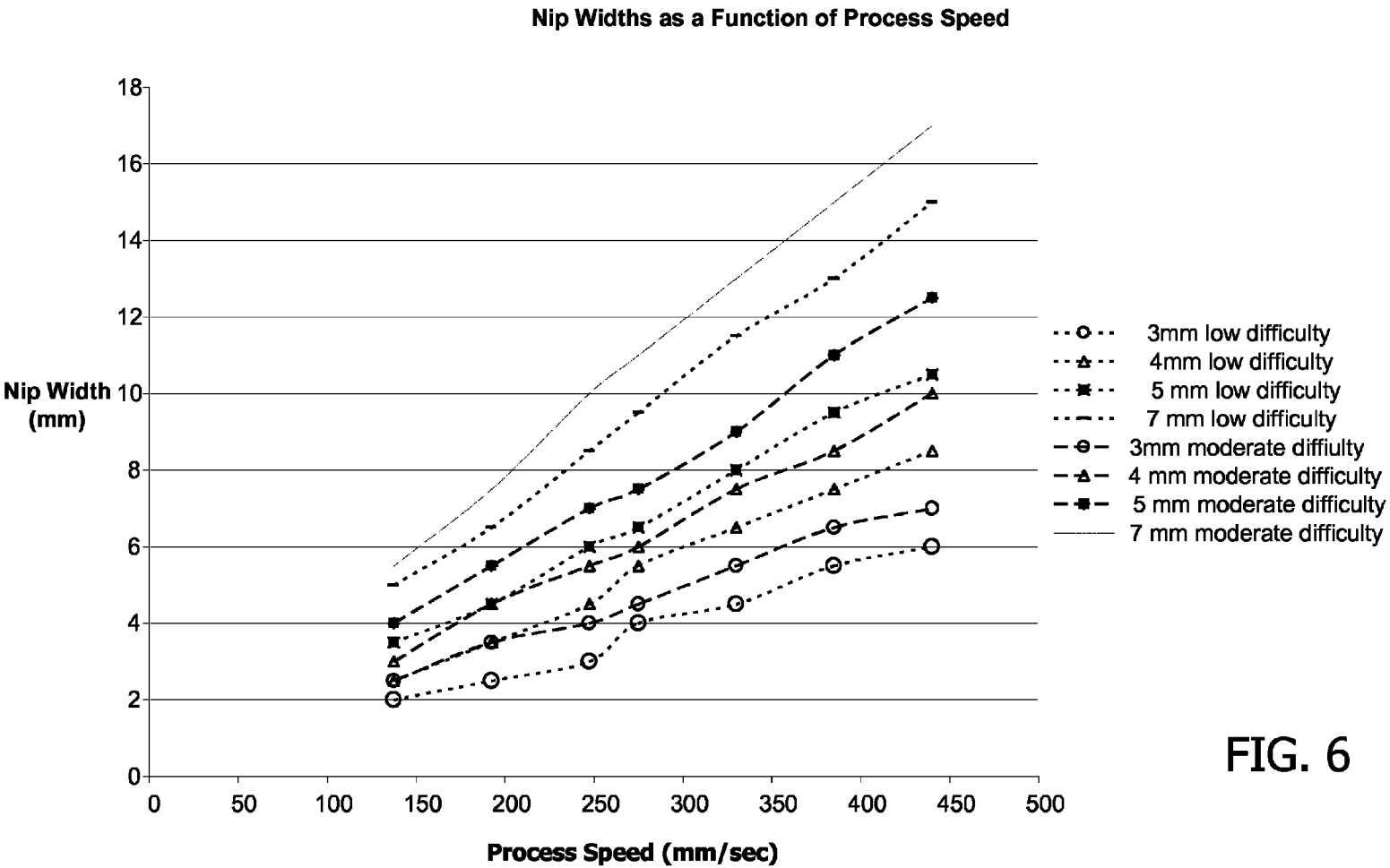
FIG. 6 is a chart illustrating the relationship between process speed and transfer nip width in accordance with exemplary embodiments of the present invention.
Figure 7:
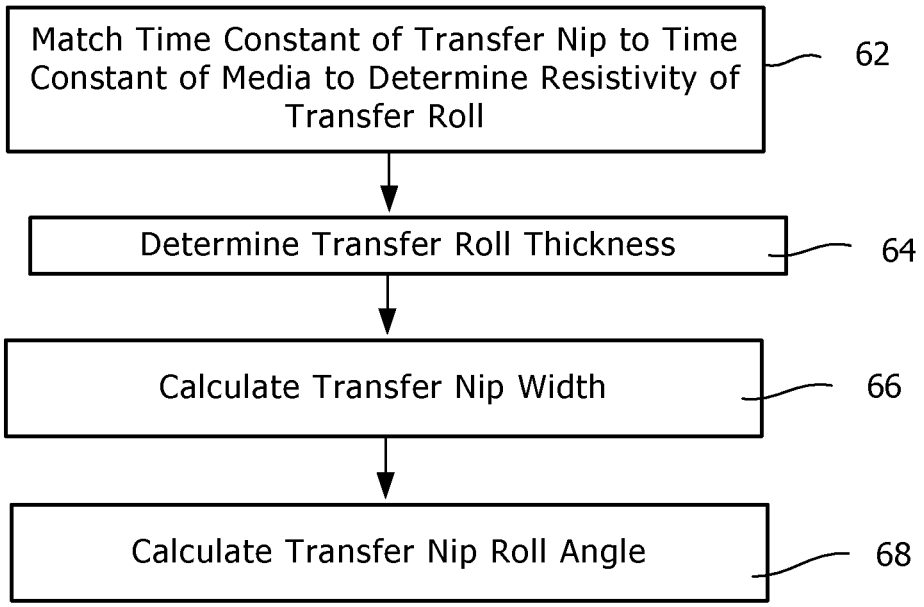
FIG. 7 is a flowchart illustrating a design flow for a transfer nip according to exemplary embodiments of the present invention.

FIG. 6 is a flow chart of a method for specifying the electrical and geometric parameters of a transfer nip 25 and 56 in accordance with an exemplary embodiment of the present invention. At 62, the resistivity of transfer roller 21 and 54 is determined by identifying the media sheet type on which imaging apparatus 40 is to print having the longest time constant, and adjusting the resistivity of transfer roller 21 and 54 so that the time constant of transfer nip 21 and 54 substantially matches or exceeds the time constant of the identified media sheet. At 64, the foam thickness of transfer roller 21 and 54 is determined based upon the minimum or near minimum process speed of imaging apparatus 40 and 100, the toner charge and the thickness and roughness of the identified media sheet. With the resistivity and thickness of transfer roll 21 and 54 determined, the width of transfer nip 25 and 56 may be determined at 66. For transfer nip 56, the position of transfer roll 54 and backup rolls 52 and 55 may be determined. The pressure between transfer roll 54 and backup roll 52 is at least equal to the pressure between transfer roll 54 and backup roll 55.

It will be apparent to those skilled in the art that various modifications and variations can be made to the present invention without departing from the spirit and scope of the invention. For example, it is understood that each of transfer roll 21 and 54 may be implemented using a plurality of transfer rolls and a belt surrounding the rolls. In this way, such transfer rolls and the corresponding belt would allow for a relatively wide transfer nip width for accommodating higher process speeds. Thus it is intended that the present invention cover the modifications and variations of this invention provided they come within the scope of the appended claims and their equivalents.

What is claimed is:

1. An electrophotographic imaging apparatus, comprising:
at least one toner transfer device comprising:
a donating member for donating toner forming an image;
a transfer roll which serves to form a transfer nip in which toner is transferred from the donating member to a media sheet disposed in the transfer nip between the donating member and the transfer roll; and
first and second rolls engaging the transfer roll such that the transfer roll and the first and second rolls form the transfer nip; and
a mechanism for rotating the transfer roll.

2. The apparatus of claim 1, wherein the transfer roll comprises a foam layer having a thickness between about 3 mm and about 6 mm.

3. The apparatus of claim 1, wherein the transfer nip has a width between about 6 mm and about 12 mm.

4. The apparatus of claim 3, wherein the mechanism for rotating provides a process speed between about 250 mm/sec and about 350 mm/sec, and the width of the transfer nip is between 6 mm and about 10 mm.

5. The apparatus of claim 3, wherein the mechanism for rotating provides a process speed between about 350 mm/sec and 450 mm/sec, and the width of the transfer nip is between 6 mm and about 12 mm.

6. The apparatus of claim 2, wherein the thickness of the foam layer is between about 4 mm and about 6 mm.

7. The apparatus of claim 1, wherein an angle formed between the first roll, the transfer roll and the second roll is between about 45 and 49 degrees.

8. The apparatus of claim 1, wherein an amount of pressure between the transfer roll and the first roll is less than an amount of pressure between the transfer roll and the second roll.

9. The apparatus of claim 1, wherein the first roll includes a dielectric coating having a thickness of about 50 microns.

10. The apparatus of claim 1, wherein the second roll includes a dielectric coating having a thickness of about 50 microns.

11. The apparatus of claim 1, wherein a difference between a bias voltage applied to the transfer roll and a bias voltage applied to the second roll is about 1800 volts in a relatively dry environment in which the relative humidity is less than or equal to about 3 grams of water per cubic meter of air.

12. The apparatus of claim 1, wherein a difference between a bias voltage applied to the transfer roll and a bias voltage applied to the second roll is about 500 volts in a relatively humid environment in which the relative humidity is at least about 12 grams of water per cubic meter of air.

13. The apparatus of claim 1, wherein a product of a resistivity of the transfer nip and a dielectric constant of the transfer nip is greater than or equal to a product of a resistivity of the media sheet and a dielectric constant thereof.

14. The apparatus of claim 1, wherein the transfer roll has a resistivity between about 9.7 log ohm-cm and about 9.9 log ohm-cm.

15. A toner transfer mechanism for an imaging apparatus, comprising:
a donating member for donating toner forming an image; and
a transfer roll which serves to form a transfer nip in which toner is transferred from the donating member to a media sheet disposed in the transfer nip between the donating member and the transfer roll, the transfer roll having a foam layer with a resistivity between about 9.4 log ohm-cm and about 10.2 log ohm-cm and a thickness between about 3 mm to about 6 mm, and the transfer nip having a width between about 6 mm and about 12 mm.

16. The toner transfer mechanism of claim 15, further comprising a mechanism for rotating the transfer roll to provide a process speed of at least about 250 mm/sec.

17. The toner transfer mechanism of claim 16, wherein the mechanism for rotating provides a process speed between about 250 mm/sec and about 350 mm/sec and the width of the transfer nip is between 6 mm and about 10 mm.

18. The toner transfer mechanism of claim 16, wherein the mechanism for rotating provides a process speed between about 350 mm/sec and about 450 mm/sec and the width of the transfer nip is between 6 mm and about 12 mm.

19. The toner transfer mechanism of claim 15, further comprising a first roll and a second roll, wherein each first and second roll cooperates with the transfer roll such that the transfer roll and the first and second rolls form the transfer nip and wherein an angle formed between the first roll, the transfer roll and the second roll is between about 45 and about 49 degrees.

20. The toner transfer mechanism of claim 15, wherein the thickness of the foam layer of the transfer roll is between about 4 mm and about 6 mm.

21. The toner transfer mechanism of claim 15, wherein the resistivity of the foam layer of the transfer roll is between about 9.7 log ohm-cm and about 9.9 log ohm-cm.

22. An imaging apparatus having a toner transfer station, comprising:
a donating member for donating toner forming an image; and
a transfer roll which serves to form a transfer nip in which toner is transferred from the donating member to a media sheet disposed in the transfer nip between the donating member and the transfer roll, wherein a product of a resistivity of the transfer nip and a dielectric constant thereof is greater than or equal to a product of a resistivity of the media sheet and a dielectric constant thereof.

23. The apparatus of claim 22, wherein the transfer roll comprises a foam layer having a thickness such that a steady state voltage drop across the media sheet does not exceed a breakdown strength thereof.

24. The apparatus of claim 22, wherein the transfer roll has a resistivity between about 9.4 log ohm-cm and about 10.2 log ohm-cm and a process speed of at least about 250 mm/sec.

25. The apparatus of claim 24, wherein the transfer roll comprises a foam layer having a thickness between about 3 mm and about 6 mm.

26. The apparatus of claim 25, wherein the transfer nip has a width between about 4 mm and about 12 mm.

27. The apparatus of claim 22, wherein the transfer roll has a foam layer with a resistivity between about 9.4 log ohm-cm and about 10.2 log ohm-cm and a thickness between about 3 mm to about 6 mm, and the transfer nip has a width between about 4 mm and about 10 mm.

28. The apparatus of claim 22, further comprising a mechanism for rotating the transfer roll to provide a process speed of at least about 250 mm/sec.

29. The apparatus of claim 22, further comprising a backup roll which forms at least part of the transfer nip with the transfer roll, wherein a vector of a nip force between the backup roll and the transfer roll is maintained substantially perpendicular to an exit vector of the media sheet.

30. The apparatus of claim 1, wherein each of the first and second rolls engages the transfer roll via the donating member.

* * * * *